United States Patent [19]

Holahan et al.

[11] 4,422,644

[45] Dec. 27, 1983

[54] BOARD GAME APPARATUS

[75] Inventors: Edward T. Holahan, Chicago; Harry Disko, South Barrington, both of Ill.

[73] Assignee: Marvin Glass & Associates, Chicago, Ill.

[21] Appl. No.: 318,336

[22] Filed: Nov. 5, 1981

[51] Int. Cl.[3] ..... A63F 3/00

[52] U.S. Cl. ..... 273/249; 273/280; 273/287

[58] Field of Search ..... 273/287, 280, 294, 249, 273/282

[56] References Cited

U.S. PATENT DOCUMENTS

| | | | |
|---|---|---|---|
| 919,148 | 4/1909 | Flint et al. | 273/287 |
| 2,460,264 | 1/1949 | Prentice et al. | 273/243 |
| 2,780,463 | 2/1957 | Salomon | 273/249 |
| 3,149,843 | 9/1964 | Braun | 273/282 X |
| 3,181,867 | 5/1965 | Dreyer | 273/282 |
| 3,184,237 | 5/1965 | Riva | 273/249 X |
| 3,201,129 | 8/1965 | McFarland et al. | 273/249 X |
| 3,865,381 | 2/1975 | Hayes | 273/280 X |

*Primary Examiner*—Richard C. Pinkham
*Assistant Examiner*—Scott L. Brown

[57] ABSTRACT

A board game apparatus includes a housing having a playing surface defined thereon. A plurality of spaced playing piece receiving apertures are arranged in a pattern on the playing surface. A playing piece support surface is arranged beneath the playing surface to support one or more playing pieces, sized to pass through the playing piece receiving apertures, within the apertures. A plurality of deflectable elements are arranged on the support surface, aligned beneath certain of the apertures, to allow a playing piece to be pushed through the support surface and the playing surface into the interior of the housing. The playing surface is rotatably mounted on the housing to enable the position of the apertures to be varied with respect to the position of the deflectable elements on the support surface.

14 Claims, 4 Drawing Figures

BOARD GAME APPARATUS

BACKGROUND OF THE INVENTION

1. Field of the Invention

This invention relates generally to board game apparatus and specifically to such an apparatus including means for capturing an opponent's playing piece.

2. Background Art

Board game apparatus in which one or more players move their playing pieces along a predetermined path, capturing their opponent's playing pieces on the way, such as shown in U.S. Pat. No. 3,709,497 are well known in the art. Also, game boards having flexible portions for retaining game pieces have been known, such as shown in U.S. Pat. No. 3,705,727. While these games have generated considerable entertainment value for many years, there is a continuing demand for new game apparatus of this variety which enable the opponent's playing pieces to be captured in an amusing manner.

SUMMARY OF THE INVENTION

These and many other objects of the present invention are achieved by a board game apparatus including a housing and a playing surface defined on the housing. The playing surface includes a plurality of spaced playing piece receiving apertures. At least two playing pieces are sized to pass through the apertures. The playing piece support surface on the housing beneath the playing surface is arranged to support the playing pieces in the apertures. A plurality of deflectable elements arranged on the support surface are aligned beneath less than all of the apertures to allow a playing piece to be pushed through the support surface into the interior of the housing.

DETAILED DESCRIPTION OF THE PREFERRED EMBODIMENT

Figure 1:
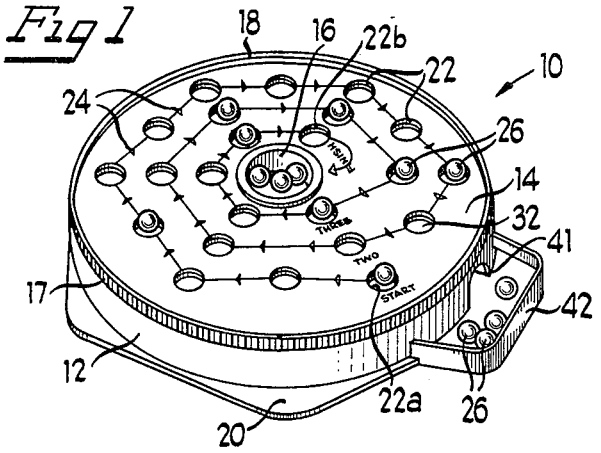
FIG. 1 is a perspective view of one embodiment of the present invention.

Referring to the drawing wherein like reference characters are used for like parts throughout the several views, a board game apparatus 10, shown in FIG. 1, includes a housing 12, conveniently made by conventional plastic molding techniques in a generally cylindrical shape, supported atop an outwardly extending apron 20. A circular, rotatable playing surface 14 is fixed to a cup-shaped central hub 16 fitted for free rotation within the housing 12.

The playing surface 14 includes a peripheral upstanding rim 18 with a roughened gripping surface 17 and a plurality of spaced playing piece receiving apertures 22 which extend completely through the playing surface 14. The apertures 22 are generally arranged in a radially symmetrical pattern conveniently with sets of three radially aligned apertures angularly spaced from one another by approximately 60° and an intermediate aperture 22 located at the 30° position between each adjacent pair of three radially aligned apertures. Conveniently, twenty-three such apertures are utilized, one aperture being labelled as the "START" aperture **22*a* and successive apertures being connected by the arrow indicia 24 to indicate a preferred course of travel along the playing surface 14 terminating at the apertures 22*b* marked "FINISH". The preferred course of travel is conveniently from one adjacent aperture 22 to the next in a converging spiral pattern. After completing the indicated pattern a preferably spherical playing piece 26, such as a ball or marble, used to mark a player's position is deposited in the central hub 16. Conveniently playing pieces 26 of different color are used by different players to identify the various playing pieces 26**.

Figure 2:
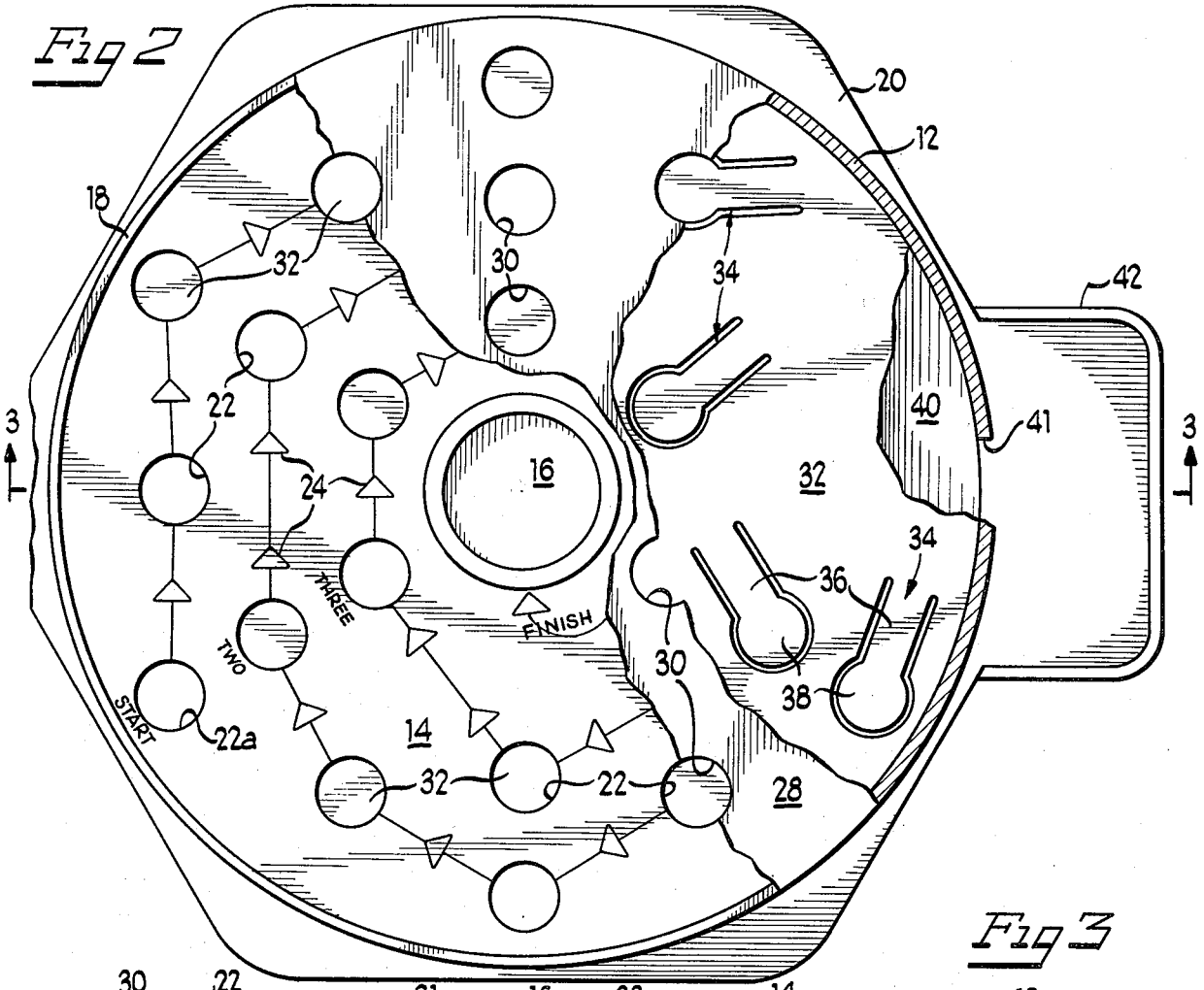
FIG. 2 is an enlarged, cutaway, top plan view of the embodient of the present invention shown in FIG. 1.
Figure 3:
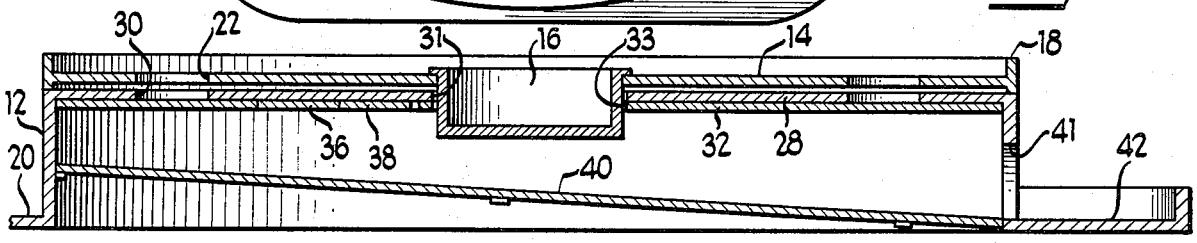
FIG. 3 is a cross-sectional view taken generally along the line 3—3 in FIG. 2.

A playing piece support surface shield 28, forming the upper surface of the housing 12, is located directly beneath and flush against the playing surface 14, as shown in FIGS. 2 and 3. The shield 28 includes a plurality of openings 30 also sized to allow the playing pieces 26 to pass through them, preferably having the same size and arranged in the same pattern as the apertures 22. Thus, the apertures 22 may be aligned with the openings 30 by the appropriate rotation of the surface 14 with respect to the shield 28. While the apertures 22 and openings 30 are circular in the illustrated embodiment, any configuration will suffice as long as a playing piece 26 may pass through an aligned aperture 22 and opening 30.

Fixed to the underside of the shield 28 is a playing piece support surface 32. Preferably, the surface 32 normally closes the bottom of the openings 30. This allows a playing piece 26, sized to pass through the openings 30 in the shield and the apertures 22 in the surface 14, to be supported atop the surface 32 while retained within an aperture 22 and opening 30 so as to be visible from above the playing surface 14. The hub 16 is retained within central circular passages 31 and 33 in the shield 28 and surface 32 respectively, for sliding rotation relative to the housing 12.

Figure 4:
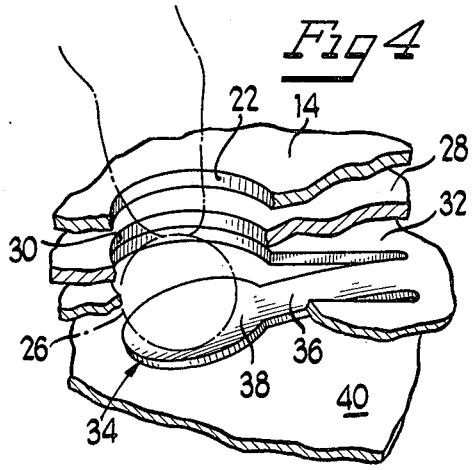
FIG. 4 is an enlarged, fragmentary view of a playing piece receiving aperture and aligned deflectable elememt.

The playing piece support surface 32 includes a plurality of spaced, deflectable elements 34 conveniently integrally formed in the surface 32. Each element 34 includes a spring arm portion 36 connected to the remainder of the surface 32 and a widened, generally circular closure portion 38. The spring arm portion 36 is made of a deflectable material, such as plastic, so that in response to the application of a force to the closure portion 38, the element 34 is deflected downwardly into the interior of the housing 12. The deflectable elements 34 are located randomly at spaced locations on the support surface 32 arranged to align beneath certain of the apertures 22. Specifically, the closure portions 38 are located in alignment with some but less than all of the apertures 22 and openings 30, the size of the portions 38 conveniently being slightly larger than that of the openings 30. Conveniently, about fifteen such deflectable elememts 34 are located on the support surface 32. Thus, as shown in FIG. 4, when a playing piece 26 is positioned within an opening 30 and an aperture 22, the playing piece may be forced into the interior of the housing 12 by applying a downward pressure causing the playing piece 26 to deform the deflectable element 34 out of the way thereby creating a passage in the support surface 32 of sufficient size to pass the playing piece 26.

The interior of the housing 12 includes an inclined collection ramp 40 communicating with a collection bin 42 on the exterior of the housing 12. A playing piece 26 passing through an aperture 22 and an opening 30, past a deflectable element 34 lands on the inclined ramp 40 and is conveyed by gravity through a passage 41 to the collection bin 42 on the exterior of the housing 12 where it may be grasped by the user for repeated play.

While the apparatus 10 can be used in implementing a variety of enjoyable games, the following game is exemplary of the potential utilization of the apparatus 10. Initially, the angular position of the playing surface 14 is determined by rotating surface 14 in the embodiment illustrated to one of six different positions, angularly separated from one another by 60°, so that the apertures 22 are aligned with underlying openings 30. If desired, markings (not shown) can be included on the upstanding rim 18 and the adjacent portion of the housing 12 to facilitate correct location of the playing surface 14.

When the initial position of the surface 14 has been determined, the first player to proceed positions a playing piece 26 in the start aperture 22*a*. A die or other chance selection device (not shown) is operated to determine the number of moves allocated to that player. The player then moves the playing piece 26 the allocated number of positions counting from one aperture 22 to the next as indicated by the arrow indicia 24. Succeeding players thereafter move their playing pieces in the same manner. Each player may either move a playing piece 26 already located on the surface 14 or may begin an additional playing piece 26 at the start position 22*a*.

If a player's move causes his or her playing piece 26 to land on another player's playing piece, the player presses down on the other player's playing piece 26 as indicated in FIG. 4. If the playing piece 26 is over a deflectable element 34, the playing piece is pushed through the support surface 32 onto the ramp 40, eventually rolling into the collection bin 42. The playing piece 26 is thereby eliminated from play. However, if the player lands on a playing piece 26 not located over a deflectable element 34, as determined by pressing downwardly on the playing piece, the player must move his or her playing piece 26 one space forwardly. This must be continued until the player either finds a vacant aperture 22 or pushes another player's playing piece 26 through to the ramp 40 thereby making the playing position vacant.

At the beginning of a turn, a player may rotate the playing surface 14 to a new position, if desired. The playing surface 14 must still be aligned with the openings 30 in the new position, however the alignment of the various apertures 22 with the deflectable elements 34 is changed. As the playing surface 14 rotates, the playing pieces 26 rotate, if they are spherical, and otherwise slide over the shield 28 along with the surface 14. During this rotation of the playing surface 14, the players are unable to discern the location of the deflectable elements 34 because the fixed shield 28 conceals the outline of the elements 34. Thus, when looking through the apertures 22 as the surface 14 is rotated, the player discerns no apparent difference between the various positions of the playing surface 14.

The game may be included in a variety of ways. Conveniently, the first player to get three playing pieces 26 into the central hub by an exact count, one space beyond the aperture 22*b* marked "FINISH" is the winner.

It should be understood that numerous modifications of the invention described herein can be devised by those skilled in the art, that fall within the true spirit and scope of the principles of this invention, even if the invention is not practiced as specifically described herein.

What is claimed and desired to be secured by Letters Patent of the United States is:

1. A board game apparatus, comprising:
a housing;
a playing surface defined on said housing, including a plurality of playing piece receiving apertures;
at least two playing pieces sized to pass through said apertures;
a playing piece support surface on said housing beneath said playing surface arranged to support said playing pieces in said apertures; and
a plurality of deflectable elements formed integrally with said support surface and aligned beneath said apertures to allow a playing piece to be pushed through said support surface into the interior of said housing, said elements including a spring arm portion connected to said support surface and a widened end portion attached to said spring arm portion for closing the bottom of an aligned aperture in said support surface.

2. The apparatus of claim 1 wherein said playing surface is rotatable with respect to said support surface.

3. The apparatus of claim 2 including means for concealing the location of said deflectable elements when said playing surface is rotated.

4. The apparatus of claim 3 said concealing means including an intermediate shield located between said playing surface and said support surface, fixed to said housing and having a plurality of openings alignable with the apertures in said playing surface.

5. The apparatus of claim 1 wherein said playing surface is generally circular and said apertures are arranged in a radially symmetrical pattern.

6. The apparatus of claim 5 including an upstanding peripheral rim fixed to said playing surface.

7. The apparatus of claim 1 including means beneath said housing for collecting the playing pieces.

8. The apparatus of claim 1 wherein said playing pieces are spherical.

9. The apparatus of claim 1 including indicia means for indicating a converging spiral path of movement on said playing surface.

10. The apparatus of claim 1 in which said deflectable elements are aligned beneath less than all of said apertures.

11. The apparatus of claim 1 wherein said playing surface is rotatable with respect to said housing.

12. The apparatus of claim 11 including means for concealing the location of said deflectable elements when said playing surface is rotated.

13. A board game apparatus, comprising:
a housing;
a playing surface defined on said housing, including a plurality of playing piece receiving apertures;
at least two playing pieces sized to pass through said apertures;
a playing piece support surface on said housing beneath said playing surface arranged to support said playing pieces in said apertures, said playing piece support surface being movable with respect to said playing surface;
a plurality of deflectable elements arranged on said support surface and aligned beneath less than all of said apertures to allow a playing piece to be pushed through said support surface into the interior of said housing; and means for concealing the location of said deflectable elements when said playing surface is moved.

14. The apparatus of claim 13 wherein said concealing means includes an intermediate shield located between said playing surface and said support surface, said shield being fixed to said housing and having a plurality of openings alignable with the apertures in said playing surface.

* * * * *

UNITED STATES PATENT AND TRADEMARK OFFICE

CERTIFICATE OF CORRECTION

PATENT NO. : 4,422,644

DATED : December 27, 1983

INVENTOR(S) : Edward T. Holahan et al.

It is certified that error appears in the above-identified patent and that said Letters Patent is hereby corrected as shown below:

Column 1, lines 46 and 47, "elememt" should read -- element --.

Column 2, line 34, after "in the shield" insert -- 28 --.

Column 3, line 51, "in the new position," should read -- in its new position, --.

Column 3, line 62, "included" should read -- concluded --.

Column 3, line 64, after "the central hub" insert -- 16 --.

Signed and Sealed this

Twenty-third Day of December, 1986

*Attest:*

DONALD J. QUIGG

*Attesting Officer* *Commissioner of Patents and Trademarks*